United States Patent [19]

Schantz et al.

[11] 4,230,919

[45] Oct. 28, 1980

[54] SNAP ACTING SWITCH

[76] Inventors: Spencer C. Schantz, 16608 W. Rogers Dr., New Berlin, Wis. 53151; Gary R. Kuebler, 5506 N. 76 St., Milwaukee, Wis. 53218

[21] Appl. No.: 886,213

[22] Filed: Mar. 13, 1978

Related U.S. Application Data

[63] Continuation-in-part of Ser. No. 736,608, Oct. 28, 1976, abandoned.

[51] Int. Cl.[3] ..... H01H 21/04; H01H 1/22

[52] U.S. Cl. ..... 200/67 B; 200/244; 200/335

[58] Field of Search ..... 200/67 B, 67 C, 153 R, 200/153 H, 244, 246, 302, 335

[56] References Cited

U.S. PATENT DOCUMENTS

| | | | |
|---|---|---|---|
| 2,862,083 | 11/1958 | Bailey | 200/244 X |
| 3,073,923 | 1/1963 | Anderson et al. | 200/67 B |
| 3,200,213 | 8/1965 | Murphy, Jr. | 200/67 B |
| 3,242,281 | 3/1966 | Brevick et al. | 200/67 B |
| 3,571,541 | 3/1971 | Bedocs | 200/335 X |
| 3,604,879 | 9/1971 | Beer | 200/335 |

*Primary Examiner*—Steven M. Pollard
*Attorney, Agent, or Firm*—Henry C. Fuller

[57] ABSTRACT

A snap acting switch has a switch blade which is pivotally mounted for movement between two positions and is normally held in one position by an actuator spring. An actuator lever is pivotally mounted on the switch housing and has an external lever arm portion and an inner lever arm portion within the housing which is engageable with the actuator spring to move the spring laterally past the longitudinal axis of the switch blade in response to movement of the external actuator lever arm portion, to thereby cause snap acting movement of the switch blade from its normal position to a second position. Release of pressure on the external lever arm portion permits the actuator spring to cause snap acting movement of the switch blade back to its normal position.

18 Claims, 16 Drawing Figures

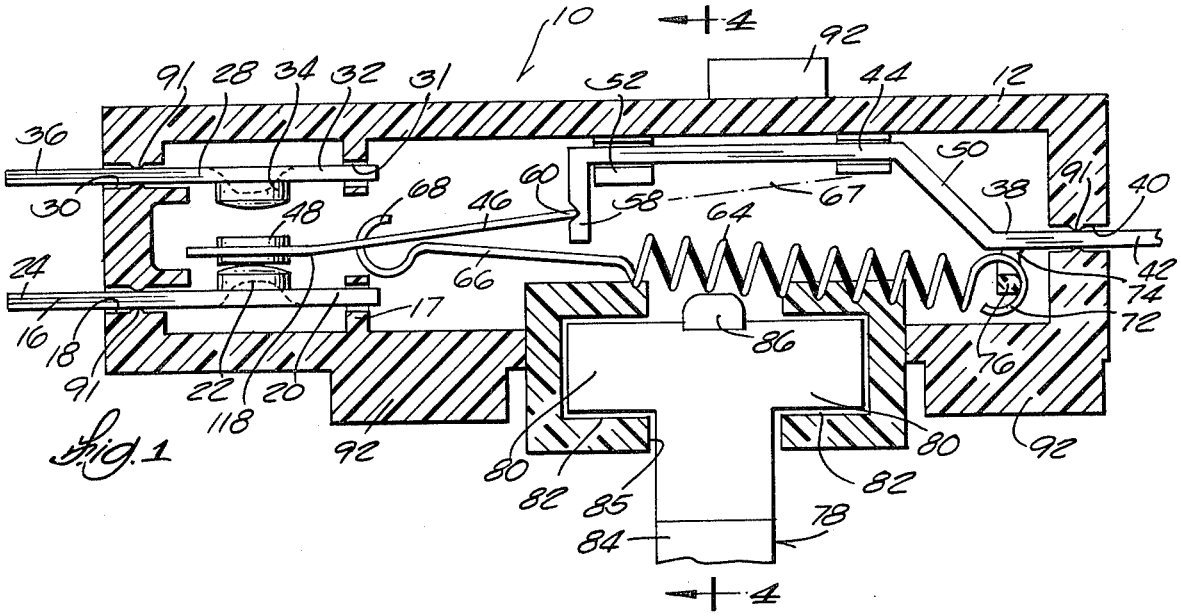
Fig. 1
Fig. 2.
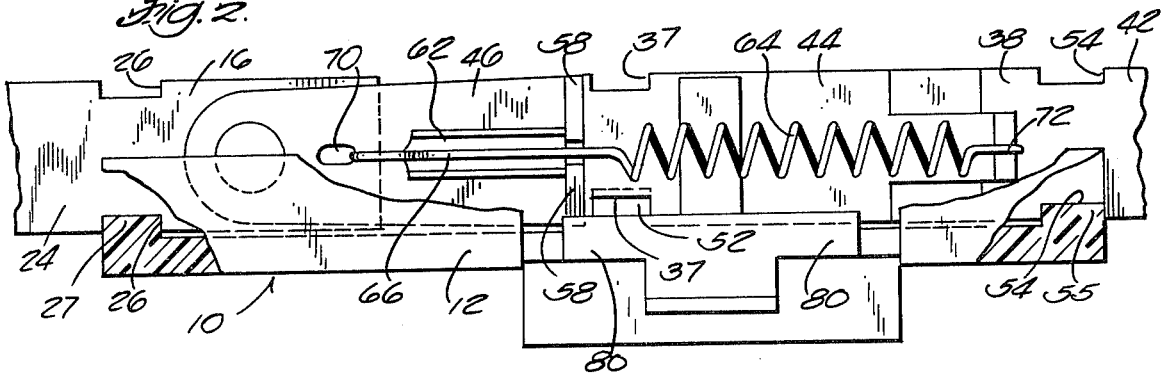
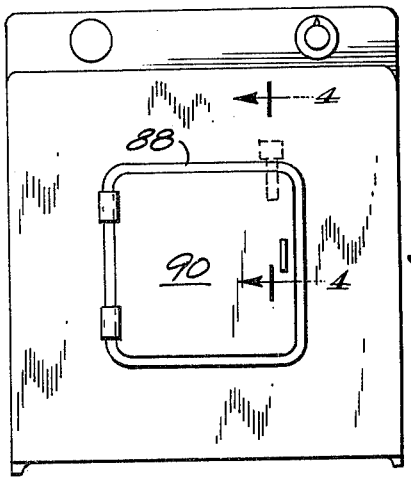
Fig. 3
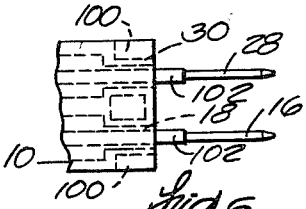
Fig. 6
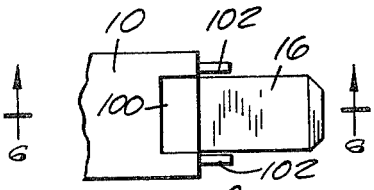
Fig. 5

SNAP ACTING SWITCH

CROSS REFERENCE TO RELATED APPLICATION

This application is a continuation-in-part application of application 736,608 filed Oct. 28, 1976, and now abandoned.

BACKGROUND OF THE INVENTION

This invention relates to snap acting electric switches of the type wherein snap acting movement of a fulcrumed switch blade is caused by applying lateral pressure to spring means which normally holds the switch blade in one of its two positions.

In the past, switches of this general type have been actuated by actuator plungers which are mounted for sliding movement transversely of the actuator springs. Such actuator plungers have an external portion which extends outside the switch housing through an opening therein and have an inside portion that is positioned to engage the actuator spring and move it laterally. However, this type of switch has the disadvantage that the actuator plunger acts as a piston and pushes air out of the interior of the switch housing when the plunger is pushed inwardly to actuate the switch, and then draws air back into the switch housing when the actuator plunger returns to its rest position. This breathing action of the switch draws dust particles into the switch housing and thus tends to reduce the reliability and lifetime of the switch.

Also, the requirement that the actuator plunger must be movable transversely of the actuator spring puts a limitation on the position of the actuator plunger and sometimes requires the use of a separate actuator arm positioned to bear against the actuator plunger as disclosed, for example, in U.S. Pat. No. 3,073,923. The use of a separate actuator arm increases both the size and the cost of the switch.

SUMMARY OF THE INVENTION

The present invention provides in an electric snap action switch having a switch blade fulcrumed within a housing with a first electrical contact thereon, having a second electrical contact mounted within the housing in cooperative relationship with the first contact, and having spring means arranged to be movable to either side of the fulcrum of said switch blade to cause snap action in the opening and closing of the contacts, and having actuator means positioned to be responsive to an external force for shifting a portion of said spring means from one side of the fulcrum to the other. The actuator comprises a lever pivotally mounted on the housing intermediate its length for rocking movement about an axis generally parallel to the longitudinal axis of the spring with the lever moving in a plane transverse or at right angles to the spring axis to shift a portion of the spring over center with respect to said fulcrum, and thereby cause snap acting movement of the switch blade from one position to another.

The use of the actuator lever moving in a plane transverse to the spring enables use of selected cam profiles on the portion of the lever which contacts the spring to provide the desired pre-travel and overtravel of the switch actuator.

Other objects of the invention are to provide a switch construction which is compact, which reduces metal costs, which can be readily assembled with a minimum of assembly labor, which has a snap-on cover, which has a contact blade so shaped as to provide for a wiping action, and which, due to the novel actuator lever design and bearings therefore, minimizes the entry of foreign matter into the housing around the actuator.

The use of thermal insulation pads floating in slots adjacent the terminals enables use of a transparent thermoplastic housing which affords inspection of the inside of the switch. It has been found that the insulation pads prevent thermal destruction of the switch upon overload.

Other objects and advantages of the invention will be apparent from the disclosure hereof.

DESCRIPTION OF THE DRAWINGS

FIG. 1 is a longitudinal sectional view of one embodiment of the invention.

FIG. 2 is a view looking at the bottom of FIG. 1, with part of the housing removed and other portions cut away to reveal inner details.

FIG. 3 is a front view of a clothes dryer utilizing the embodiment of FIGS. 1 and 2.

FIG. 5 is a fragmentary side view of a portion of the housing and terminal of a modification.

FIG. 6 is a fragmentary plan view taken on the line 6—6 of FIG. 5.

DETAILED DESCRIPTION OF THE INVENTION

Figure 4:
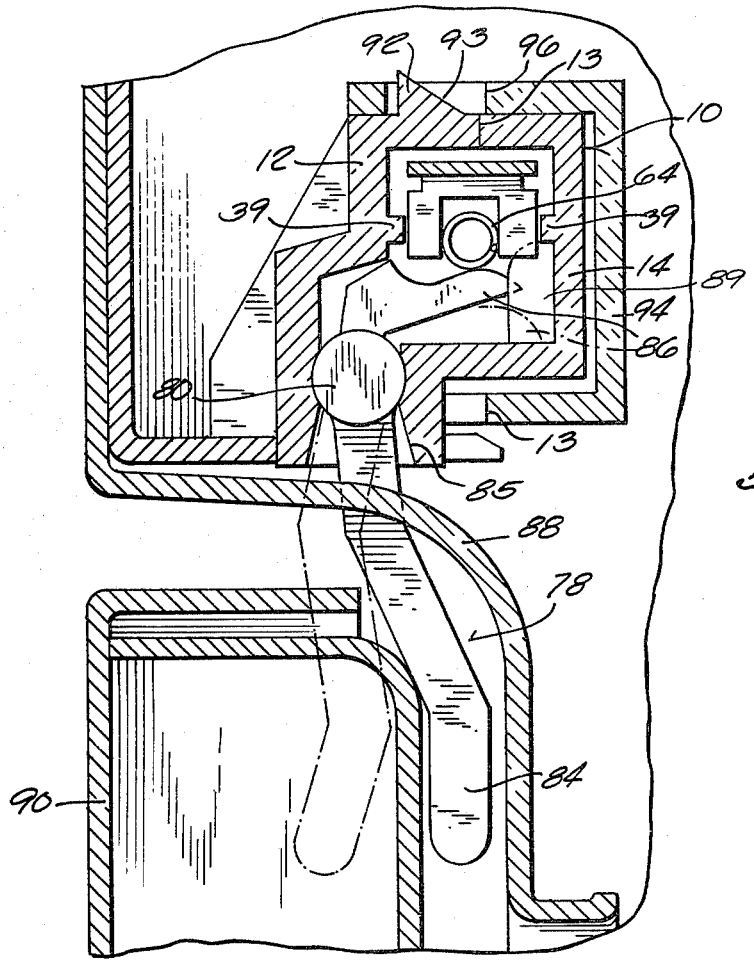
FIG. 4 is a cross-sectional view taken on the line 4—4 of FIG. 3, and also on the line 4—4 of FIG. 1.

FIGS. 1 through 4 disclose one embodiment of the invention which is mounted in a thermoplastic housing 10 made of two half shells 12 and 14 (FIG. 4) which are hermetically sealed together by ultrasonic welding as at 13. The housing is desirably constructed of a transparent plastic such as lexan polycarbonate so that the inside of the switch can be inspected when assembled and after use. This embodiment includes a first brass terminal strip 16 (FIGS. 1 and 2) which passes through a slot 18 in housing 10 and has an inwardly extending portion 20 which supports a fixed contact 22 and has an outwardly extending portion 24 which is shaped to act as a terminal. Terminal strip 16 is notched out at opposite edges 26 (FIG. 2) to fit matching projections in housing 10 at the side edges of slot 18 to hold terminal 16 in its proper position with respect to the other parts of the switch. A second brass terminal strip 28 (FIG. 1) passes through a slot 30 in housing 10 and has an inwardly extending portion 32 which supports a fixed contact 34 opposite contact 22 and has an outwardly extending portion 36 which is shaped to act as a terminal. Terminal plate 28 has side notches similar to notches 26 in terminal plate 16, but these are not visible in the drawings. The end of terminal strip 32 is supported in grooves 31 formed between lugs which project from the side walls. Similar grooves 17 support the end of terminal strip 16.

A third brass terminal strip 38 passes through a slot 40 in the other end of housing 10 and has an external portion 42 which is shaped to act as a terminal and has an inwardly extending portion 44 having an inner end which is shaped to act as a pivotal support for a bronze switch blade 46, the latter carrying a double face movable contact 48 that is movable into and out of contact with fixed contacts 22 and 34. Inwardly extending portion 44 of terminal strip 38 is offset at 50. Side edges of portion 44 engage grooves in retainer lugs 52 which hold the inner portion 44 of terminal strip 38 is proper position relative to the other parts of the switch, and bosses 39 (FIG. 4) maintain the strip centered. Edges of terminal strips 38 and 28 are notched at 54 and 26 (FIG. 2) and engage coacting projections 55 and 27 molded to project from opposite sides of the housing 10. Also strip 38 has other notches 37 receiving retainer lugs 52 to prevent longitudinal movement of terminal strips 38.

On the innermost end of terminal strip 38 are upwardly bent spaced-apart fingers 58 which act as supports for switch blade 46. Fingers 58 have V-shaped notches 60 cut into their forward faces for pivotally receiving the innermost end of switch blade 46, which has its central portion 62 (FIG. 2) open to provide clearance for the end of an actuator spring 64. Actuator spring 64 has a hook 68 engaging an opening 70 (FIG. 2) in switch blade 46. A portion of the spring passes through opening 62 in switch blade 46 when the switch is actuated. The other end of actuator spring 64 is hooked at 72 and engages an opening 74 in a lug 76 which is bent from terminal strip 38.

Spring 64 is positioned so as to normally hold switch blade 46 in the position shown in FIG. 1. Accordingly, contacts 22 and 48 form a normally closed contact pair while contacts 34 and 48 form a normally open contact pair. To cause snap action of the switch to open the normally closed contact pair and close the normally open contact pair, actuator spring 64 is moved transversely in FIG. 1 until the spring 64 swings through slot 62 past the longitudinal axis 67 of switch blade 46, at which time switch blade 46 will snap past axis 67 in FIG. 1 to close contact pair 34–48 and open contact pair 22–48. The switch will remain in this condition as long as the transverse pressure is maintained on actuator spring 64. When the transverse pressure on actuator spring 64 is released, the spring tension causes spring 64 to move in FIG. 1 until the linear end portion 66 moves back past the longitudinal axis 67 of switch blade 46 and thereby causes a snap movement of switch blade 46 back to its normal position.

The above described action of the switch is controlled by an actuator lever 78 which is pivotally mounted on housing 10 by means of trunnions 80 (FIG. 10) which rock in spaced bearings 82. The bearings 82 are formed by allochiral recesses in the housing parts and together with the closely fitting trunnions form a rotary dust seal to prevent entry of dust into the housing. The swinging movement of the inner lever arm portion 86 which actuates the spring as subsequently described is wholly confined within the switch housing and cannot cause any pumping action as with prior art switches which can cause entry of dust into the switch mechanism.

The trunnions 80 and bearings 82 provide rocking movement of the lever 78 about an axis generally parallel to the longitudinal axis 81 (FIG. 10) of the spring 64. Thus the actuator lever moves in a plane transverse to or at right angles to the axis 81 of the spring. This affords use of various cam profiles for the desired pretravel and over travel of the actuator lever 78 as subsequently described.

Actuator lever 78 has an external lever arm 84 (FIG. 4) having a portion extending through a space 85 which is flared to allow for operating movement of the lever, and has an inner lever arm portion 86 which extends inside of housing 10 and adjacent to actuator spring 64 in position to cause transverse movement of spring 64, as described above, to cause snap action of the switch. In FIG. 4 the solid line drawing of external lever arm portion 84 and inner lever arm portion 86 show the operating position thereof when the dryer door 90 is closed. The broken lines show the position when the door has been opened. As shown more particularly in FIG. 4, there is a rib 89 projecting from the wall of the shell portion 14. This rib is so positioned as to prevent the spring 64 from deflecting laterally (toward the right in FIG. 4) during operation. Such a deflection might otherwise occur because of the camming action of the lever portion 86.

In FIGS. 3 and 4 the switch is shown mounted on the door casing 88 of a clothes dryer or other appliance whose door 90 closes against outer lever arm portion 84 and causes the actuation of the switch.

It should be noted that because of the novel trunnion mounting, movement of the actuator lever 78 between the two positions shown in FIG. 4 does not cause any breathing action within the switch housing 10, thereby aiding in the obtaining of a dust-tight seal. The dust-tight seal is accomplished at the parting line 13 of the two housing shells 12 and 14 by ultrasonic welding action.

Small beads of plastic material 91 (FIG. 1) are preferably formed in portions of the slots, 18, 30 and 40, through which the terminal plates 16, 28 and 38 extend, so that portions of the beads will be melted by the ultrasonic welding action to provide an air-tight seal between housing 10 and each of the terminal strips 16, 28 and 38.

In this particular embodiment, triangular mounting lugs 92 (FIGS. 1 and 4) with tapered surfaces 93 are employed on the shell portion 12 so that a housing 94, preferably of plastic and having slightly flexible walls, can be snap mounted over case 10 (FIG. 4), housing 94 having openings 96 for receiving the mounting lugs 92 and the flexible walls sliding over the tapered surfaces of the lugs during assembly.

FIGS. 5 and 6 show a modification in which pockets 100 are formed in the side walls of housing 10 adjacent to those slots 18 and 30 (FIG. 1) which receive the terminal strips 16 and 28. Pockets 100 provide a relatively thin wall for use in sealing off either of the slots 18 or 30 if only one terminal strip is to be used in the switch. In this case, heat is introduced against the bottom of pocket 100 over the vacant slot to cause the thermoplastic material in the bottom of the pocket to flow and fill the vacant slot to provide a dust-tight seal.

In the embodiment of FIGS. 5 and 6, housing 10 has molded plastic projections 102 on either side of the terminal strips 16 and 28 which project far enough to act as abutments to prevent the terminals 16 and 28 from being inserted into a socket past the ends of projections 102. In the past, this function has been performed by stop shoulders on the brass terminals 16 and 28. However, by replacing the brass shoulders with plastic projections 102 on the housing 10, a significant saving in brass results without any additional cost, since the plastic projections 102 are molded integrally with the housing 10.

Figure 7:
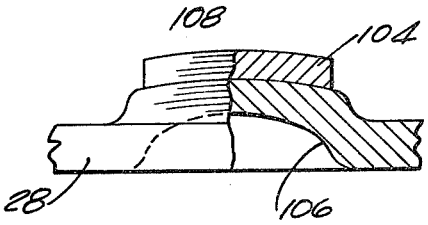
FIG. 7 is an enlarged fragmentary longitudinal sectional view of the fixed contact structure for the embodiment shown in FIGS. 1 through 4.

Another novel feature of this invention is that the double-headed movable contact 48 has flat faces while the fixed contacts 22 and 34 have semi-spherical contacts. This is different from the prior art, in which the semi-spherical surfaces have been on the movable contact and the flat surfaces have been on the fixed contact. The structure of semi-spherical contacts 34 is shown more clearly in FIG. 7. A relatively thin layer of silver 104, for example, having a thickness of approximately 0.020 inches, is either welded or coined on the surface of the inner side of the terminal strip 28, which in this example is approximately 0.032 inches thick. When initially deposited, the silver layer 104 is flat. Subsequently, the portion of terminal strip 28 directly underneath the silver layer 104 is upset or punched in by a semi-spherically headed tool which produces a semi-spherical concavity 106 directly under silver layer 104, causing the other side of the terminal plate 28 to protrude at 108. This causes silver layer 104 to assume the semi-spherical shape illustrated where the silver layer 104 is in the form of a spherical shell portion or a slice through a hollow sphere. This method of forming the semi-spherical contacts provides a significant saving both of silver and of brass compared to prior art methods of forming semi-spherical contacts.

Figure 8:
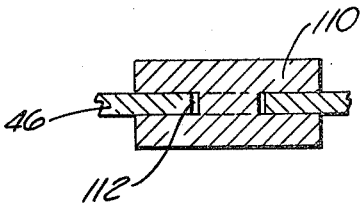
FIG. 8 is an enlarged fragmentary longitudinal sectional view of the movable contact structure for the embodiment shown in FIGS. 1 through 4.
Figure 9:
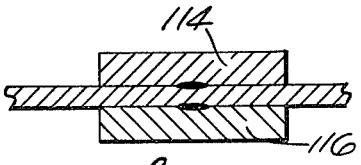
FIG. 9 is an enlarged fragmentary longitudinal sectional view of an alternate structure of the movable contact for the embodiment shown in FIGS. 1 through 4.

The flat movable contact 48 can be formed on switch blade 46 by a double-headed silver rivet-like piece 110 which passes through an opening 112 in switch blade 46 and which is headed onto switch blade 46 as shown in FIG. 8. As an alternative, flat contacts 48 can be formed by welding two discs of silver 114 and 116 onto opposite faces of switch blade 46, as shown in FIG. 9. Also, switch blade 46 may be slightly bent at 118 (FIG. 1) to cause a scrubbing action of flat contacts 48 on semi-spherical contacts 22 and 34 during opening and closing of the switch.

From the above it is apparent that the novel lever arrangement with the trunnion-type internal pivot reduces cost, provides for compactness of the switch housing, provides for reliability, and reduces the possibility of foreign matter entering the housing around the actuator. It is also apparent that by using the notches 54, 26 and 37 in the metal strips, and by having coacting projections formed from the inexpensive plastic of the housing, such as the projections 27, 55 and 52, that there is a substantial saving in metal. It is also apparent that by having the plastic projections 102 instead of laterally projecting shoulders from metal terminals, such as the terminals 16 of FIG. 5, that there is a further saving in metal cost. The use of the novel design shown in FIG. 7 to form spherical contacts on the fixed contact members reduces the cost by permitting use of a very thin uniform thickness of silver 104. The conventional alternative to this design required additional silver to generate the spherical radii on a moving contact such as the contact 48. This arrangement also permits the use of a thin uniform thickness of silver as in FIGS. 8 or 9 on the blade.

The integrally molded lugs 92 with the tapered surfaces 93 allow for simple assembly of a snap-on cover. In addition, the use of the pockets 100 (FIGS. 5 and 6), opposite the slots 18 and 30 in a plastic housing, permits sealing of one or the other of the slots in situations where the construction is to have only one terminal, this being accomplished by the insertion of a heated instrument into one of the pockets 100 to cause the plastic from the bottom of the pocket to flow into slot sealing condition. In addition, the bend 118 in the blade, in conjunction with the spherical contact surfaces on the contacts 22 and 34, provides for a wiping action during switch closing.

Figure 10:
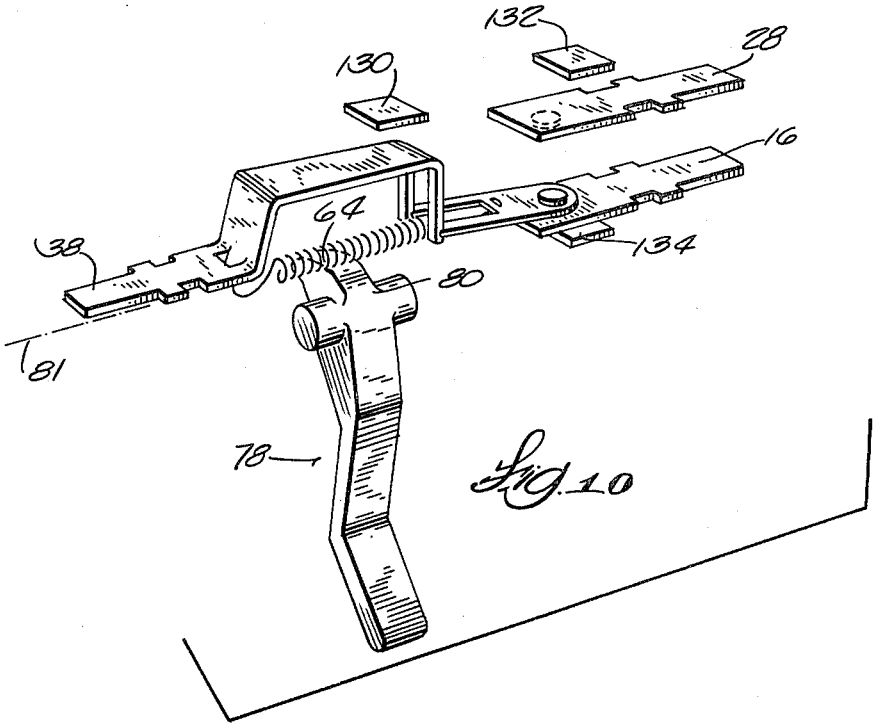
FIG. 10 is a fragmentary perspective view of a modified embodiment showing the switch actuator lever, spring and contacts and thermal insulation pads.
Figure 11:
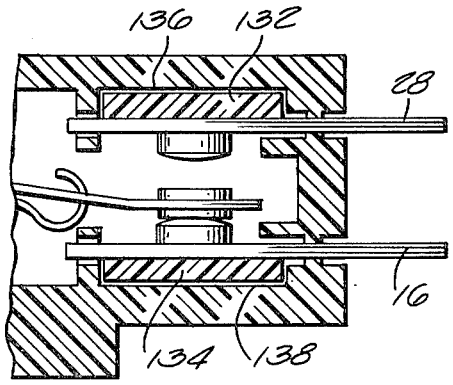
FIG. 11 is a fragmentary sectional view of the modified embodiment of the invention in which thermal insulating pads are located between the fixed contacts and housing.
Figure 12:
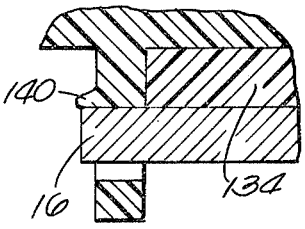
FIG. 12 is a fragmentary sectional view showing a thermal insulating pad maintaining and stabilizing the position of a terminal after overload has melted portions of the plastic housing.

FIGS. 10, 11 and 12 illustrate the use of thermal insulation pads 130, 132, 134 which prevent severe damage to a thermoplastic housing caused by overload and heating of the switch terminals 16, 28, 38. The pads 130, 132, 134 can be vulcanized fiber sheet material commonly called "fish paper" and used as electrical insulation in electrical appliances.

The pads 132, 134 are positively positioned in pockets or recesses 136, 138 in the plastic housing which are deeper than the thickness of the pads to provide clearance and a loose fit between the pads and terminals. FIG. 12 illustrates a terminal 16 which has been heated by overload and has melted and deformed a portion 140 of the plastic housing with the terminal shifted to bear against the pad 134. The pad 134 thus stabilizes the terminal and prevents the terminal from being completely disoriented from its normal operative position. A laboratory test of a switch in accordance with the invention employing a thermoplastic housing without the insulation pads at a 60 amp load for two minutes resulted in a major disruption of the plastic housing with a portion of a terminal extending out the side of the switch opposite the lever 78. The pads prevented this from occurring in other tests. It has been found that short pads as illustrated are effective to accomplish the intended objectives.

Figure 16:
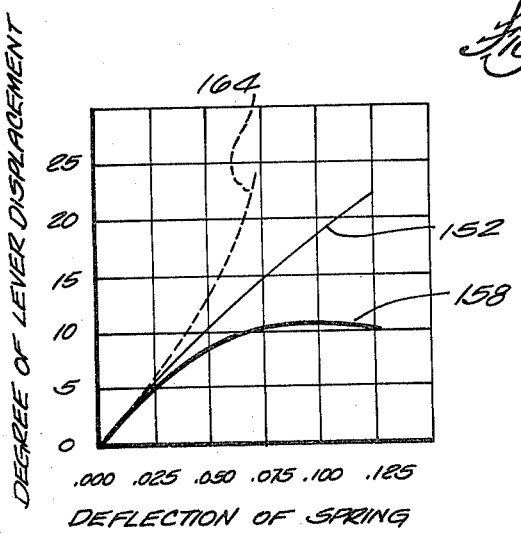
FIG. 16 is a chart illustrating the degree of spring displacement relative to the degree of lever displacement for the cam profiles illustrated in FIGS. 13, 14 and 15.
Figure 13:
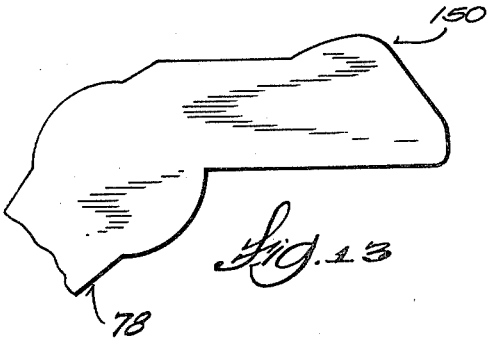
FIG. 13 is an enlarged view of a linear cam profile on the switch actuator.
Figure 14:
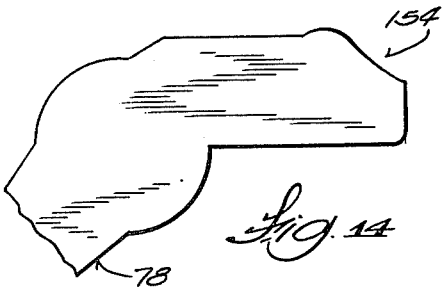
FIG. 14 is a view similar to FIG. 13 of a regressive cam profile.
Figure 15:
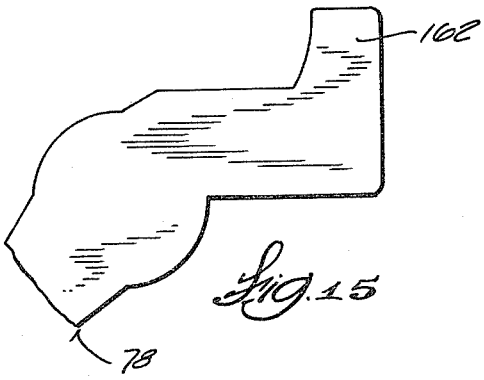
FIG. 15 is a view similar to FIG. 13 of an aggressive cam profile.

FIGS. 13, 14 and 15 show various cam profiles for the end 150 of the actuator lever 78 which engages the spring 64. FIG. 13 illustrates a cam surface in which the deflection of the spring responds linearly to action of lever 78 as illustrated by line 152 in FIG. 16. FIG. 14 illustrates a regressive cam surface 154 which provides over-travel of the lever after engaging the spring to minimize damage to the spring or other parts or prevent dislodging of the spring. The deflection of spring relative to lever displacement or the FIG. 14 profile is illustrated in FIG. 16 curve 158. In FIG. 15 an aggressive cam profile 162 is shown in which there is very little pre-travel of the lever before the spring 64 is shifted over center. Curve 164 in FIG. 16 illustrates the action of the FIG. 15 profile.

It is apparent from the foregoing that use of an actuator lever 78 which moves in a plane transverse or at right angles to the axis of the spring affords the use of various cam profiles to achieve certain objectives in switch action for particular requirements. Moreover, selection of an appropriate cam profile will accommodate certain manufacturing tolerances for the various switch parts.

What we claim is:

1. In an electric snap-action switch having a housing, a switch blade fulcrumed within said housing, having a first electrical contact on said switch blade, having a second electrical contact mounted within said housing in cooperative relationship with said first contact, having spring means arranged to be movable to either side of the fulcrum for said switch blade to cause snap opening and snap closing of said contacts, and having actuator means positioned to be responsive to an external force for shifting a portion of said spring means from one side of said fulcrum to the other, the improvement wherein said actuator means comprises a lever, means for pivotally mounting said lever on said housing intermediate its length for rocking movement about an axis parallel to the longitudinal axis of said spring for movement of the lever in a plane transverse to said spring and the longitudinal extent of said switch blade and having an external end and having an integral inner portion positioned for swinging in response to said rocking movement in a direction to engage and shift a portion of said spring means over center with respect to said fulcrum.

2. An electric snap-action switch as claimed in claim 1 in which there are oppositely projecting trunnions intermediate the length of said lever, in which the housing has bearings for said trunnions spaced inwardly of the exterior of the housing, and in which there is an outwardly enlarged lever-receiving space outwardly of said bearings to allow for operating movement of the lever.

3. An electric snap-action switch as claimed in claim 2 in which the housing is substantially sealed against dust, and in which the bearings snugly receive said trunnions for rocking movement while substantially excluding the entrance of foreign matter.

4. An electric snap-action switch as claimed in claim 1 in which the switch blade is formed of flexible metal and has one end pivoted within the housing and has a longitudinal opening therein, and wherein the spring means is a coiled spring having one end connected to the housing and having its other end connected to the switch blade with a portion positioned to pass through the longitudinal opening of the blade during operation, and wherein the internal portion of the actuator lever is positioned to swing against said coil spring to shift it over center in response to an external force on the external end of the actuator lever.

5. An electric snap-action switch as claimed in claim 1 in which said switch blade has a transverse bend intermediate its pivoted end and its contact end located to cause a wiping action during operation.

6. An electric snap-action switch as claimed in claim 1 in which the housing is plastic and has an end, and in which there are two slots for contact-carrying terminal strips, and in which there is a thin wall section of the plastic housing forming the wall of at least part of each of said slots whereby a selected slot may be sealed by inserting a heated instrument adjacent said thin wall portions to cause plastic material to flow into slot closing relationship.

7. An electric snap-action switch as claimed in claim 1 in which the housing is plastic, and in which there is a flat terminal strip extending into the housing and having edge portions with notches, and in which there are projections molded to project from the side walls of the housing to engage said notches and restrain longitudinal movement of the terminal strip.

8. An electric snap-action switch as claimed in claim 1 in which the housing is plastic and has a slot, and in which there is a terminal strip in said slot carrying one of said contacts, and in which there is a transverse plastic bead projecting from the walls of said slot and heat sealed around a portion of said strip to exclude the entrance of foreign matter.

9. An electric snap-action switch as claimed in claim 1 in which the housing is plastic and has molded laterally projecting lugs with tapered surfaces, and in which there is a cover having slightly flexible walls with openings positioned to receive said lugs for snap assembly of said cover.

10. An electric snap-action switch as claimed in claim 1 in which there is a fixed metal terminal strip supporting said second contact, and in which the contacting surface of said second electrical contact is a thin layer of silver supported on a spherical shell portion of said terminal strip having convex and concave spaced surfaces and said silver layer being complementary in shape to said spherical shell portion to provide a spherical contact portion.

11. An electric snap-action switch as claimed in claim 1 in which there is means in the housing positioned to prevent lateral movement of the spring means during its shifting movement.

12. An electric snap-action switch as claimed in claim 11 in which said means for preventing lateral movement comprises a rib projecting inwardly from the housing and having an edge positioned to prevent said lateral movement of the spring.

13. An electric snap-action switch in accordance with claim 1 wherein said inner portion of said lever has a cam surface to engage said spring means and shift a portion of said spring means over center with respect to said fulcrum.

14. The electric snap-action switch of claim 13 wherein said cam surface is regressive and permits overtravel of said lever after said spring means is shifted overcenter.

15. The electric snap-action switch of claim 13 wherein said cam surface is aggressive and affords minimal pre-travel of said lever prior to shifting of said spring over center.

16. In an electric snap-action switch having a housing, a switch blade fulcrumed within said housing, having a first electrical contact on said switch blade, having a second electrical contact mounted within said housing in cooperative relationship with said first contact, having spring means arranged to be movable to either side of the fulcrum for said switch blade to cause snap opening and snap closing of said contacts, and having actuator means positioned to be responsive to an external force for shifting a portion of said spring means from one side of said fulcrum to the other, the improvement wherein said actuator means comprises a lever, means for pivotally mounting said lever on said housing intermediate its length for rocking movement about an axis in a plane generally parallel to the longitudinal axis of said spring and having an external end and having an integral inner portion positioned for swinging in response to said rocking movement in a direction to engage and shift a portion of said spring means over center with respect to said fulcrum.

17. An electric snap-action switch in accordance with claim 1 wherein said housing is formed from two housing half shells secured together along a longitudinal split line, said housing half shells having wall portions defining a space through which said external lever end extends, said space being on the longitudinal split line, and wherein said means for pivotally mounting said lever comprises oppositely projecting trunnions intermediate the length of said lever, allochiral recesses in said half shells which cooperate to form bearings for said trunnions, said bearings being spaced inwardly of the exterior of the housing, said trunnions closely fitting in said recesses to form a rotary dust seal for said space to prevent entry of dust into said housing through said space.

18. The electric snap-action switch of claim 1 wherein the housing is made of thermoplastic including recesses within said housing adjacent said contacts and thermal insulating pads in said recesses between said terminals and said housing to stabilize said terminals when in excessive overload and prevent disorientation of said terminals and destruction of said housing.

* * * * *